United States Patent [19]

Londono

[11] Patent Number: 5,007,200

[45] Date of Patent: Apr. 16, 1991

[54] WINDOW SECURITY SYSTEM

[76] Inventor: Gustavo Londono, 9117 Tivoli Pl., Boca Raton, Fla. 33434

[21] Appl. No.: 478,518

[22] Filed: Feb. 12, 1990

[51] Int. Cl.[5] ..... E05B 65/10

[52] U.S. Cl. ..... 49/141; 49/13; 49/57

[58] Field of Search ..... 49/141, 13, 57, 50, 49/56

[56] References Cited

U.S. PATENT DOCUMENTS

| | | | |
|---|---|---|---|
| 4,055,360 | 10/1977 | Russi | 49/141 X |
| 4,057,935 | 11/1977 | Rohrberg et al. | 49/141 X |
| 4,070,048 | 1/1978 | Young | 49/141 X |
| 4,127,966 | 12/1978 | Schmidt | 49/141 |
| 4,164,095 | 8/1979 | Musacchia | 49/141 X |
| 4,263,747 | 4/1981 | Coltrin et al. | 49/141 X |
| 4,304,070 | 12/1981 | Musacchia | 49/141 X |
| 4,634,157 | 1/1987 | Fernandez | 49/141 X |
| 4,638,596 | 1/1987 | Gallardo | 49/141 X |
| 4,816,807 | 3/1989 | Schmitt | 49/141 X |

*Primary Examiner*—Philip C. Kannan
*Attorney, Agent, or Firm*—Harry W. Barron

[57] ABSTRACT

A window bar security system has a grill of bars positioned outside a building window and held by a plurality of standoffs. Two of the standoffs are latching standoffs and extend from opposite sides of the grill through the wall and into the building and each latching standoffs includes a hole at the distal end. Four other guiding standoffs are inserted into receptacles against coil springs and the four guiding standoffs are positioned in pairs on opposite sides and equi-distant from each latching standoff. A pair of sliding bolt mechanisms are affixed to the inner wall of the building and positioned to permit the sliding bolt of each to fit into one of the latching standoff holes and to be moved towards the center of the window to release the latching standoffs. A pair of security pins are provided with one end designed to fit into a sliding bolt mechanism for preventing the unintentional movement of the sliding bolt and with another end shaped in the form of a hook. Each pin is tied by a string to a sliding bolt and the string is of such a length to permit the hooks of the two pins to be fastened together and still maintain the strings generally horizontal. To release the grill, the affixed strings are pulled to simultaneously move the sliding bolts out of the latching standoff holes. The pins and sliding bolt mechanism may be connected to an electronic security system.

18 Claims, 2 Drawing Sheets

WINDOW SECURITY SYSTEM

This invention relates to a window security system and more particularly, to a window bar system which is easily and quickly detachable from the interior to permit exit through the window in the event of an emergency.

BACKGROUND OF THE INVENTION

In the modern world, many homes and businesses must take extraordinary steps to prevent criminal entry into the premises. These steps commonly include the installation of security bars or a security grill over windows included in the building. Typically, these security grills are permanently affixed to the building exterior over the windows. For security reasons, measures must be taken to prevent the easy removal of the installed grill, particularly from the outside of the building.

Making the security grill difficult to remove creates a major safety problem in the event of a fire, or other emergency, since there may be no other exit available except through the windows. Besides creating a safety hazard, permanently barred windows may violate building codes, particularly where the bars cover bedroom windows, which typically are the only emergency exits from the bedroom.

DESCRIPTION OF THE PRIOR ART

Examples of security grills used to protect windows are shown in U.S. Pat. No. 3,763,615 in the name of K. Yamazaki, entitled "Method of Constructing A Window Accessory" and in U.S. Pat. No. 4,514,932 in the name of James Janis, entitled "Security System Window Guard Apparatus and Anchor Assembly Therefor".

In the past, many various protective and/or decorative window security grills have included means accessible from within the building to release the protective grill. These include the apparatus shown in: U.S. Pat. No. 4,055,360 in the name of B. C. Russi, entitled "Security Lock"; U.S. Pat. No. 4,070,048 in the name of P. Young, entitled "Releasable Window Guard"; U.S. Pat. No. 4,263,747 in the same of G. E. Coltrin et al, entitled "Window Grille Latch System"; U.S. Pat. No. 4,634,157 in the name of J. S. Fernandez, entitled "Window Guard and Latching Mechanism Therefor"; U.S. Pat. No. 4,653,226 in the name of E. L. Woodrow, entitled "Window Security Unit"; U.S. Pat. No. 4,756,122 in the name of C. J. Snapka, entitled "Removable Window Bar"; U.S. Pat. No. 4,771,574 in the name of L. Stephans, entitled "Quick Release Burglar Bar"; and U.S. Pat. No. 4,796,384 in the name of D. R. Warwick, entitled "Adaptable Security Grille and Latching Mecanism".

The apparatus in each of the above mentioned references is not totally effective in securing the premises because a person desiring entry can break the window being protected and reach in and release the security bars. Further, the mechanisms of the devices shown in the prior art is complex, difficult and can be time consuming to remove and prone to becoming jammed when an attempt to remove the mechanism occurs. In the event of a fire or other emergency, time is of the essence and significant delays or inoperability in releasing the window bars could be life threatening. Further, none of the devices described in the prior art are attachable with a conventional security system to automatically call for assistance, or merely to sound an alarm in the event of an unauthorized break-in.

SUMMARY OF THE INVENTION

What is needed is a window bar security device which is easily releasable from the interior of a protected building in a quick and simple manner, and which remains effective against an attempt to break the protected window and release the device by reaching inside from the outside.

In accordance with one aspect of this invention, there is provided a releasable window security device for protecting against entrance to a building through a window. The device includes a security grill for being positioned on the exterior of the building and a plurality of posts extending perpendicularly from the grill. At least two of the posts are of sufficient length to extend to the interior of the building and include openings at the distal end thereof. In addition, the device includes guide means mountable around the window for receiving the posts, at least two of the guide means including spring means biased against the device when the posts are received in the guide means. Finally, the device includes a pair of actuable latch means, each for being mounted in the interior of the building at a position to engage a different one of the openings for maintaining the device in a fixed position protecting the window and each being actuable to be disengaged from the openings to permit the automatic release of the device from the window.

BRIEF DESCRIPTION OF THE DRAWINGS

One preferred embodiment of the subject invention is hereafter described, with specific reference being made to the following Figures, in which.

DETAILED DESCRIPTION

Figure 1:
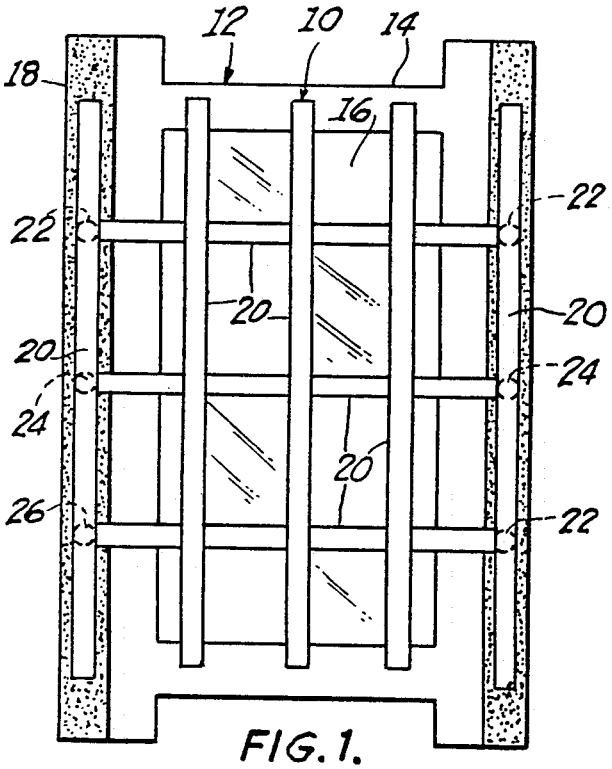
FIG. 1 is a view of the window security system of the subject invention from the outside looking inward.
Figure 2:
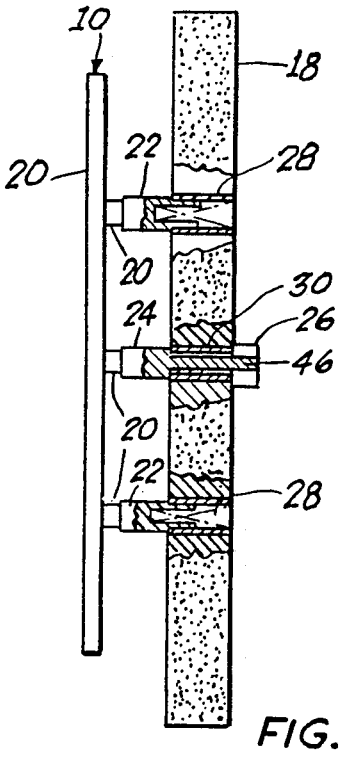
FIG. 2 is a side view, partially in cut-away, of the window security system of FIG. 1.

Referring now to FIGS. 1 and 2, the basic structure of the window security system 10 of the subject invention will be described. System 10 is a releasable security bar system for placement over a conventional window 12 of the type typically found in a home or commercial building. Window 12 includes a window frame 14 and one or more panes of glass 16. Frame 14 is mounted in the side of a building wall 18, which may be concrete block, wood or other conventional constructional materials.

Security system 10 includes a plurality of vertical and horizontal bars 20 which are spaced apart and extend over the entire surface of window 16. Further, the outer two vertical bars 20 are positioned over wall 18. The spacing between bars 20 is selected so that a person, even a child, cannot fit therebetween. However, the spacing between bars 20 is left sufficiently large to permit the passage of air and light through window 12. For a conventional size home bedroom window, for example, five vertical and three horizontal bars 20 may be used, although this will vary depending on the size of the window.

System 10 is maintained affixed to and spaced from wall 18 and window 12 by six standoff mechanisms, three of which are shown in FIG. 2. The other three standoff mechanisms are identical to those shown in FIG. 2, but extend from the other side of system 10. The upper and lower standoff mechanisms on each side are guiding standoffs 22 and are shown in detail in FIG. 3. The center standoff mechanism on each side is a latching standoff 24 and is shown in detail in FIG. 4. Latching standoff is connected by a latching mechanism 26, which is shown in detain in FIGS. 5, 6, 7 and 8. Briefly, the four guiding standoffs 22 are inserted against coil springs 32 (seen in FIG. 3) in receptacles 28 therefor and the two latching standoffs 24 are inserted through two receptacles 30 and extend entirely through wall 18 to permit two corresponding latching mechanisms 26 to be inserted in a hole 46 therein to hold the entire system 10 in place. When the latching mechanisms 26 are operated to release latching standoff 24, the springs 32 within receptacle 28 force system 10 outward and away from window 12.

Figure 3:
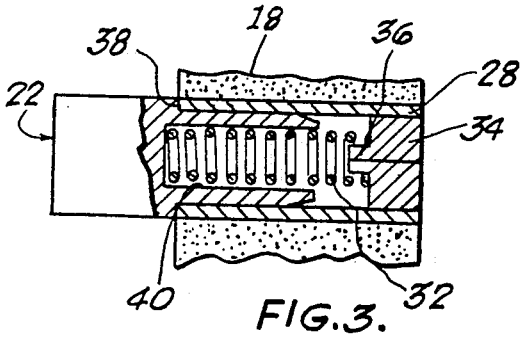
FIG. 3 is a more detailed view of the guide posts and receptacles therefor as shown in FIG. 2.

Referring now to FIG. 3, guiding standoff 22 and receptacle 28 therefor are shown in detail. Receptacle 28 is a hollow cylinder having a smooth inner surface and is affixed in wall 18. A backing member 34, having a cylindrical extension 36 extending axially therefrom, is affixed at the end of receptacle 28 remote from the end thereof into which guiding standoff is inserted. The size of extension 36 is selected to permit it to fit into the open center of spring 32. While not shown, backing member 34 may include a flange to be affixed to the inside of wall 18 for holding receptacle 28 in place and/or may further include adjusting means, such as threads and means to permit rotation of backing member 34, so as to permit compensation for tension differences between the four springs 32 in receptacles 28.

Guiding standoff 22 is affixed to one of the bars 20 and includes a shoulder 38 and a hollow center 40 sized to receive spring 32. Shoulder 38 is designed to fit against the outside facing edge of receptacle 28 when guiding standoff 22 is fully inserted into receptacle 28. Standoff 22 may be of a length to substantially extend to backing member 34 and the portion from shoulder 38 to the end thereof towards backing member 34 has a smooth surface, so as to permit it to easily slide within the smooth inner surface of receptacle 28.

Figure 4:
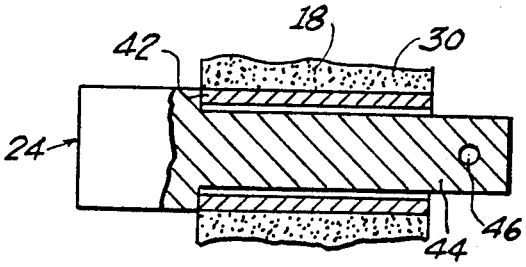
FIG. 4 is a more detailed view of the fastening posts and receptacles therefor as shown in FIG. 2.

Referring now to FIG. 4, latching standoff 24 and receptacle 30 therefor are shown in detail. Receptacle 30 is a hollow cylinder having a smooth inner surface and is affixed into wall 18. Latching standoff 24 is affixed to one of the bars 20 and includes a shoulder 42 and a cylindrical post 44 extending from the shoulder 42 area. Shoulder 42 is designed to fit against the outside facing edge of receptacle 30 when latching standoff 24 is fully inserted into receptacle 30. Post 44 is sized to have a diameter less than the inner diameter of receptacle 30 and a length sufficient to extend beyond the inner side of wall 18. In addition, a hole 46 is placed radially through in post 44 slightly inward of wall 18 when shoulders 42 rest against receptacle 30.

Referring now to FIGS. 5, 6, 7 and 8, latching mechanism 26 is shown in detail and generally includes a sliding bolt type of mechanism, in which the sliding bolt is designed to fit into hole 46 of post 44 when system 10 is fully inserted, and which is quickly releasable by a simple procedure. More specifically, latching mechanism 26 includes a base 48 having an opening 50 positioned towards one end thereof and sized to receive post 44. Affixed to base 48 is a bolt guide member 52 and a pair of separated blocks 54 and 56 are attached above base 48 and bolt guide 52 and separated by a channel 58. A pair of shrink fit pins 49 maintain blocks 52 and 54 separated.

Figure 6:
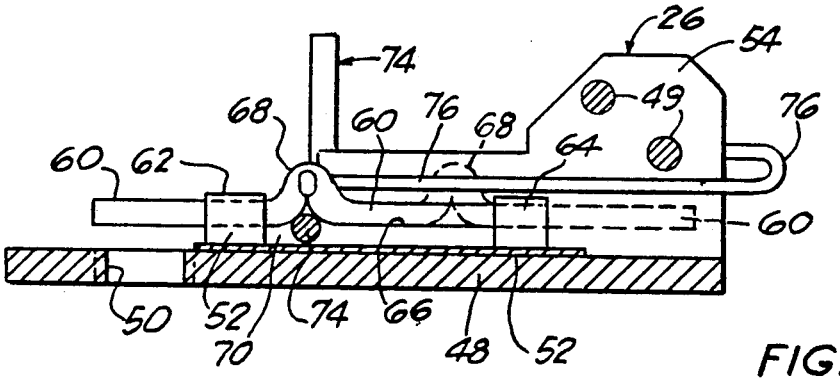
FIG. 6 is a cross-sectional view of the latching mechanism used with the window security system taken across lines 6—6 of FIG. 5.

A sliding bolt 60 is positioned in channel 58 and slides through a pair of guides 62 and 64 between a forward position, as seen by the solid lines in FIG. 6, and the back position, as seen by the dashed lines in FIG. 6. Between guides 62 and 64, member 52 is bent upward to form a guide channel 66 for bolt 60. When bolt 60 is in the forward position, it extends across, or at least well over, opening 50 in block 48.

Bolt 60 includes a U shaped bend 68 therein positioned so as to be against guide 62 when bolt 60 is in the forward position and against guide 64 when bolt 60 in is the back position. A semicircular cut 70 is made in channel 66 at the open space below the U bend 68, when bolt 60 is in the forward position. Further, the forward edge 72 of each of blocks 54 and 56 are positioned just behind the cut 70. A pin 74 is inserted through the open portion of the U bend 68 and cut 70 so as to rest against the forward edge 72 of blocks 54 and 56, thereby preventing bolt 60 from moving.

Figure 7:
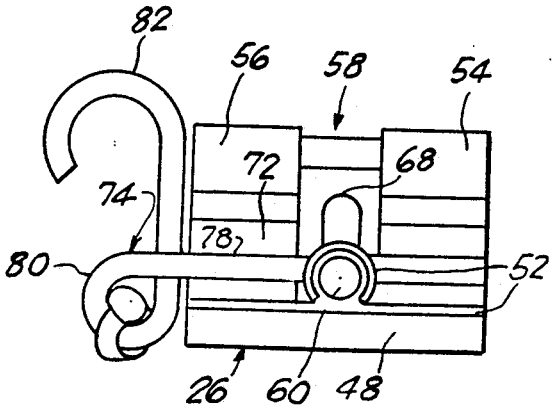
FIG. 7 is a front view of the latching mechanism used with the window security system.
Figure 5:
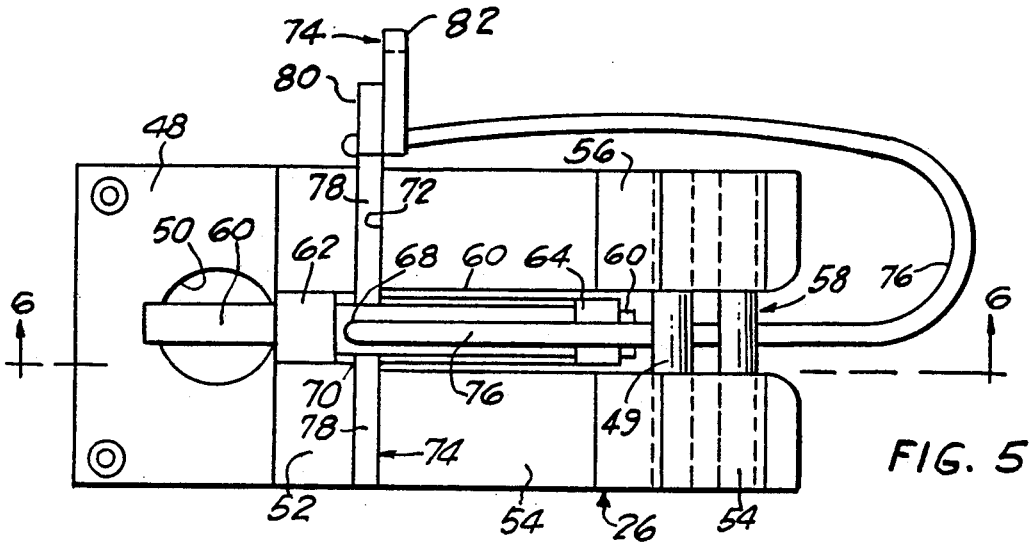
FIG. 5 is a top view of the latching mechanism used with the window security system.
Figure 8:
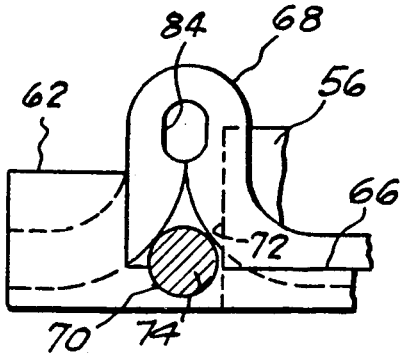
FIG. 8 is a more detailed view of the pin placement in the latching mechanism shown in FIGS. 5 through 7.

In order to release bolt 60, it is necessary to remove pin 74. A string 76, or other filament type material, is tied between the upper portion of the U bend 68 and the pin 74. Pin 74, as best seen in FIG. 7, may be shaped to have a straight portion 78 for being inserted through the space between the lower part of the U bend 68 and cut 70, a loop portion 80 for having the string 76 attached thereto and a hook portion, the function of which will be hereafter explained with respect to FIG. 9. As best seen in FIG. 8, in forming the U bend 68, the legs of the U may be bent so as to be close together and a hole 84 may be drilled or formed in the closed end of the U sufficient large to permit string 76 to be secured to the U bend 68.

Figure 9:
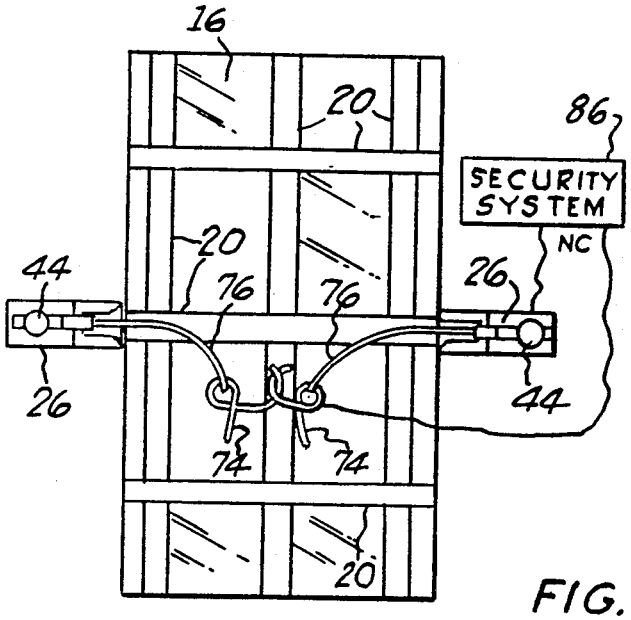
FIG. 9 is a view of the window security system from the inside, looking outward, and illustrates how the security system is released.

Referring now to FIG. 9, the manner of using the apparatus described above with respect to FIGS. 1–8 will now be described. In normal usage, System 10 is inserted against window 12 by inserting the four guiding standoffs 22 and two latching standoffs 24 into the receptacles 28 and 30 as far as shoulders 38 and 42 permit. When system 10 is fully inserted against the bias of springs 32, holes 46 extend into the interior beyond wall 18. At this point, the two ends of sliding bolts 60 are placed in the holes 46. The outward bias imparted by springs 32 hold the ends of sliding bolts 60 in holes 46 and maintain system 10 in place. Finally, pins 74 are inserted as seen in FIG. 8 and system 10 is securely locked in place.

If an emergency occurs requiring an exit through window 12, pins 74 are removed from latching mechanism 26 and the hook portion 82 of one pin 74 is attached to the other hook portion 82 of the other pin 74. String 76 is selected to be of such a length so as to permit the two hook portions 82 to be easily fastened together and still remain aligned approximately horizontally between latching mechanisms 26. Because of the outward bias imparted by springs 32, sliding bolt 60 remains in hole 46 until a force is applied to move them. It should be noted that in order to prevent jamming, it is necessary to release both sliding bolts 60 from the two holes 46 simultaneously. Thus, after the two hook portions 82 are connected together, they and string 76 are pulled outward and/or downward, thereby causing sliding bolts 60 to be simultaneously pulled from hole 46 in post 44. The springs 32 then force system 10 outward, permitting a person to exit through window 12.

Because the two guiding standoffs 22 are equi-spaced on both sides of the latching standoff 24, and further because of the smooth surfaces on both the interior of receptacles 28 and 30 and the exterior of the standoffs 22 and 24, system 10 is easily and automatically released from window 12 as soon as both strings 76 and hooked pins 74 are pulled. Of particular importance is the necessity to release both sides of system 10 simultaneously or a jam can occur and the structure shown in FIG. 9 permits the simultaneous release of both sliding bolts 60 from holes 46.

In order to further prevent unauthorized break-ins through window 12, one may attach pin 74 and latching mechanism 46 to a conventional security system 86. This may be done by connecting the two terminals of a normally closed (NC) port of security system 86 to the pin 74 and one of the blocks 54 or 56. As long as pin 74 is connected through the U bend 68 and in electrical contact with the blocks 54 and 56, the security system sees a closed circuit and does not trigger an alarm. However, when pin 74 is removed and used to release system 10, the closed circuit condition is broken and an alarm is triggered by security system 86. The alarm will provide security detection of a person from breaking window 12 and releasing system 10 as described above. The security system can further be programmed to call the fire and/or police department in the event pins 74 are removed from latching mechanism 46.

What is claimed is:

1. A releasable window security device for protecting against entrance to a building through a window, said security device comprising:

a security grill for positioning on the exterior of said building;

first and second pairs posts extending perpendicularly from said grill, said first pair of said posts being of sufficient length to extend to the interior of said building and including an opening at the distal end thereof;

at least four guide means mountable around said window for receiving said first and second pairs of posts, at least two of said guide means including spring means biased against said second pair of posts when said posts are received in said guide means; and a pair of actuable latch means, each for being mounted in the interior of said building at a position to engage a different one of said openings for maintaining said device in a fixed position protecting said window and each being actuable to be disengaged from said openings simultaneously to permit the automatic release of said device from said window.

2. The invention according to claim 1 wherein said means for disengaging is manually operable.

3. The invention according to claim 1 wherein said latch means includes means for connection to a electronic security system for causing said security system to provide an alarm whenever said latch means is disengaged.

4. The invention according to claim 1 wherein said grill is quadrilateral and has four sides; and wherein there are three posts on each of two opposite sides of said grill, the center one of the three posts including said openings.

5. The invention according to claim 4 wherein said center post is midway between the remaining posts on each side of said grill.

6. The invention according to claim 5 wherein at least four of said guide means including spring means biased against said device when said posts are received in said guide means; and wherein the two outer posts on each side of said grill are positioned to be reveived by said four guide means which include spring means.

7. The invention according to claim 4 wherein at least four of said guide means including spring means biased against said device when said posts are received in said guide means; and wherein the two outer posts on each side of said grill are positioned to be reveived by said four guide means which include spring means.

8. The invention according to claim 7 wherein said device further includes means for disengaging said pair of latch means at the same time.

9. The invention according to claim 8 wherein said means for disengaging is manually operable.

10. The invention according to claim 4 wherein said device further includes means for disengaging said pair of latch means at the same time.

11. The invention according to claim 10 wherein said means for disengaging is manually operable.

12. The invention according to claim 10 wherein said latch means includes means for connection to a electronic security system for causing said security system to provide an alarm whenever said latch means is disengaged.

13. A detachable window bar assembly for fitting over a window assembly mounted in a building wall, said bar assembly comprising:

a security grill;

first and second guide posts extending from opposite sides of said grill, the ends of each guide post including spring receiving means formed therein;

first and second latching posts, each extending from opposite sides of said grill and each including an opening near the end thereof remote from said grill, said latching posts being sized to extend entirely through said wall when said bar assembly is mounted;

first and second guide post receiving means capable of being mounted and positionable in said wall to receive a guide post, each guide post receiving means including a spring stop and a spring positionable between said spring stop and a guide post when inserted in said guidepost receiving means; and first and second sliding latches affixed on the side of said wall opposite to said grill and operable to be inserted into said latching post openings to maintain said grill over said window and to be removed from said openings to permit the release of said grill.

14. The invention according to claim 13 wherein said bar assembly includes a pair of guide posts extending from both opposite sides of said grill, the ends of each guide post including spring receiving means formed therein; and wherein said latching posts are positioned between said pair of guide posts.

15. The invention according to claim 14 wherein said bar assembly further includes means to operate said latches simultaneously.

16. The invention according to claim 13 wherein at least one of said latches includes means for connection to a electronic security system for causing said security system to provide an alarm whenever said latch means is disengaged.

17. A window security assembly for protecting a window from entry, said assembly comprising:

security means affixed to the exterior of a window for preventing entry therethrough;

latching means for holding said security means affixed and for being manually operated to permit the rapid release of said security means, said latching means including an electrically conductive release pin and an electrically conductive latch base, said release pin must being removed from said latch base to operate said latching means; and means for connecting said said release pin and said latch base to a security system for causing an alarm upon operation of said latching means.

18. The invention according to claim 17 wherein a normally closed output terminal of said security system is connected between said release pin and said latch base.

* * * * *